US008998017B2

(12) United States Patent
Oohori et al.

(10) Patent No.: US 8,998,017 B2
(45) Date of Patent: Apr. 7, 2015

(54) CONTAINER, LID BODY AND METHOD OF SEAMING A CONTAINER

(75) Inventors: Kei Oohori, Yokohama (JP); Kazuhiko Tsukada, Yokohama (JP); Ryuichi Amagai, Isehara (JP)

(73) Assignees: Toyo Seikan Kaisha, Ltd., Tokyo (JP); Nissan Motor Co., Ltd., Yokohama-Shi (JP)

( * ) Notice: Subject to any disclaimer, the term of this patent is extended or adjusted under 35 U.S.C. 154(b) by 0 days.

(21) Appl. No.: 13/989,624

(22) PCT Filed: Oct. 21, 2011

(86) PCT No.: PCT/JP2011/074279
§ 371 (c)(1),
(2), (4) Date: May 24, 2013

(87) PCT Pub. No.: WO2012/070342

PCT Pub. Date: May 31, 2012

(65) Prior Publication Data

US 2013/0240529 A1 Sep. 19, 2013

(30) Foreign Application Priority Data

Nov. 26, 2010 (JP) ..... 2010-264001

(51) Int. Cl.
*B65D 41/00* (2006.01)
*B65D 6/30* (2006.01)
(Continued)

(52) U.S. Cl.
CPC *B65D 7/36* (2013.01); *B21D 51/32* (2013.01); *B21D 51/40* (2013.01); *B65D 7/06* (2013.01)

(58) Field of Classification Search
CPC ..... B65D 25/34; B65D 2585/88; B65D 1/22; B65D 7/36; B65D 7/06; B21D 51/32; B21D 51/40; H01M 2/0285; H01M 2/404; H01M 10/0436
USPC ..... 429/163; 206/703; 220/309.2, 657, 601; 413/27, 6
See application file for complete search history.

(56) References Cited

U.S. PATENT DOCUMENTS 2,455,737 A 12/1948 Coyle
4,361,246 A * 11/1982 Nelson ..... 220/619
(Continued)

FOREIGN PATENT DOCUMENTS

FR 493 777 A 8/1919
JP 62-214841 A1 9/1987
(Continued)

OTHER PUBLICATIONS

International Search Report dated Dec. 13, 2011.
European Search Report, European Application No. 11842526.3, dated Aug. 1, 2014 (6 pages).

*Primary Examiner* — Andrew Perreault
*Assistant Examiner* — James M Van Buskirk
(74) *Attorney, Agent, or Firm* — Burr & Brown, PLLC

(57) ABSTRACT

The present invention provides a container, a lid body and a method of seaming a container, in which the influence of a load at the time of seaming can be made as small as possible, in the container having a seaming flange portion and a seaming curl portion notched. In a container of a structure in which a seaming flange portion formed at an open end portion of a container body, and a seaming curl portion formed on a periphery of a bottom lid are seamed to be joined to each other, and in which a notch is formed in at least one of the seaming curl portion and the seaming flange portion, a short and small curl portion in which a width of protrusion of the seaming curl portion is partially short is formed in at least one of circumferentially opposite sides of the notched portion.

6 Claims, 5 Drawing Sheets

(51) Int. Cl.

| | |
|---|---|
| ***B21D 51/32*** | (2006.01) |
| ***B21D 51/40*** | (2006.01) |
| ***B65D 6/02*** | (2006.01) |

(56) References Cited

U.S. PATENT DOCUMENTS 7,772,518 B2 * 8/2010 Rajesh et al. ..... 219/121.64
7,910,241 B2 * 3/2011 Amagai et al. ..... 429/163

FOREIGN PATENT DOCUMENTS

| | | | |
|---|---|---|---|
| JP | H09-225565 | A | 9/1997 |
| JP | 2006-089076 | A1 | 4/2006 |
| JP | 2006-092884 | A1 | 4/2006 |
| JP | 2006-321509 | A1 | 11/2006 |
| JP | 2007-014971 | A1 | 1/2007 |

* cited by examiner

CONTAINER, LID BODY AND METHOD OF SEAMING A CONTAINER

BACKGROUND OF THE INVENTION

1. Field of the Invention

The present invention relates to a container of a structure in which a seaming curl portion or a seaming flange portion is partially cut or notched, and to a lid body used therewith and a method of seaming a container.

2. Description of Related Art

Such a kind of conventional seamed container has a structure as shown in FIG. 5, for example.

That is, a seaming curl portion 121 protruding or hanging over the periphery of a lid body 120 is put on a seaming flange portion 111 formed at an open end portion of a container body 110, so that the seaming curl portion 121 and the seaming flange portion 111 are seamed together to be joined to each other by means of a seaming roll 130.

The seaming curl portion 121 extends in an outward direction through a chuck wall portion 123 which rises from the periphery of a panel 122, as shown in (C) and (D) in FIG. 5, and at the time of seaming, an inner periphery of the chuck wall portion 123 is pushed or pressed down by a chuck 140, and the chuck 140 receives a pressing force due to the seaming roll 130 through the chuck wall portion 123.

However, in cases where a notch 150 is formed in the seaming curl portion 121 in advance so as to form a partial opening in a seam portion of a container in a manner as illustrated, a stress concentrates on the vicinity of the notch 150, which is easy to cause abnormal deformation. In particular, in the case of the container having a polygonal or square shape, as shown in (C) in FIG. 5, seam shaping is simple bending shaping in a straight line region L between corner portions, but becomes draw forming in a corner portion C, as a result of which, though the pressing force due to the seaming roll 130 is supported by the chuck 140, the force acting on a straight line region between the corner C and an adjacent next corner portion beyond the corner portion C becomes large, so that when the notch 150 exists in this portion, a stress concentrates on the vicinity of the notch 150, thus giving rise to a problem of buckling and caving in.

A seaming structure of a container having such a notch 150 is described in the following first and second patent documents, for example.

PRIOR ART REFERENCES

Patent Documents

[First Patent Document] Japanese patent application laid-open No. 2006-89076

[Second Patent Document] Japanese patent application laid-open No. 2006-92884

SUMMARY OF THE INVENTION

The present invention has been made so as to solve the problems of the conventional techniques as referred to above, and has for its object to provide a container of a structure, a lid body and a method of seaming a container, in which the influence of a load or stress at the time of seaming can be made as small as possible, in a seaming flange portion or a seaming curl portion having a notch formed therein.

In order to achieve the above-mentioned object, a container of the present invention has a structure in which a seaming flange portion formed at an open end portion of a container body, and a seaming curl portion formed on a periphery of a lid body are seamed to be joined to each other, wherein said container has a notched portion formed in at least one of said seaming curl portion and said seaming flange portion, is characterized in that in at least one of circumferentially opposite sides of said notched portion, there is formed a short and small seaming portion which is seamed by a short and small curl portion in which a width of protrusion of said seaming curl portion is partially short.

In addition, in the container of the present invention, 1. it is preferred that the container body and the lid body be each of a polygonal shape with rounded corner portions, and that said notched portion be formed in a region between corner portions, and that the short and small curl portion of said seaming curl portion be formed in a region including a corner portion in the vicinity of the notched portion.

In addition, a lid body for a container according to the present invention, which is provided with a seaming curl portion which is overlapped on and seamed with a seaming flange portion formed at an open end of a container body, is characterized in that said seaming curl portion is formed with a short and small curl portion, in which a length of protrusion of the seaming curl portion is partially short.

In addition, in the lid body for the container of the present invention, 1. it is preferred that a notched portion, and that said short and small curl portion is formed in at least one of circumferentially opposite sides of said notched portion.

2. It is also preferred that a notched portion be formed in the seaming flange portion at the side of the container body, and said short and small curl portion be formed in at least one of circumferentially opposite sides of a location overlapping with said notched portion.

3. It is also preferred that the lid body be of a polygonal shape having rounded corner portions, and the notched portion be formed in a region between adjacent corner portions and in the vicinity of one of the corner portions, and the short and small curl portion of said seaming curl portion be formed in a corner portion in the vicinity of the notched portion.

Moreover, a method of seaming a container according to the present invention in which a seaming curl portion of a lid body is overlapped on a seaming flange portion of a container body, and the seaming curl portion and the seaming flange portion thus overlapped with each other are seamed by a seaming roll which moves in a circumferential direction with respect to said seaming curl portion, is characterized by:

forming a notched portion in advance in at least either one of said seaming flange portion and said seaming curl portion before seaming thereof;

forming a short and small curl portion, in which a length of protrusion of said seaming curl portion is partially short, in said seaming curl portion in at least one of opposite sides of a region where said notched portion is arranged; and seaming said seaming curl portion and said seaming flange portion by moving said seaming roll from a short and small curl portion side toward said notched portion at the time of seaming.

Further, in the method of seaming a container according to the present invention, 1. it is preferred that the container body and the lid body be each of a polygonal shape with rounded corner portions, and that said notched portion be formed in a region between corner portions, and that the short and small curl portion of said seaming curl portion be formed in a region including a corner portion in the vicinity of the notched portion.

(Effect of the Container of the Present Invention)

In cases where the notched portion is formed in the seaming curl portion of the lid body or in the seaming flange portion of the container body, when the seaming roll enters or advances upon seaming, the lid body or the container body is liable to be subjected to abnormal deformation due to the insufficient strength thereof in the vicinity of the notched portion. According to the present invention, however, the short and small seaming portion seaming the lid body and the container together is formed in which the short and small curl portion is partially formed at a side of the notched portion, and hence, by causing the seaming roll to advance from the short and small curl portion side toward the notched portion, the seaming load can be reduced, so that it is possible to prevent the abnormal deformation of the lid body or the container body in the vicinity of the notched portion, thus making it possible to achieve the container of an accurate shape with the notch portion formed therein.

In particular, in cases where the container is a polygonal shaped container in which its corners are each rounded and the notched portion is formed in the vicinity of a corner portion, the corner portions are subjected to drawing work at the time of seaming, and hence, a seaming load is high at the corner portions, as a result of which when the notched portion is in the vicinity of a corner portion, abnormal deformation will be liable to occur in the vicinity of the notched portion of the container or the lid body. For that reason, by forming a region including that corner portion into the short and small curl portion, it is possible to prevent the abnormal deformation of the container body or the lid body.

(Effect of the Lid Body of the Present Invention)

In cases where the notched portion is formed in the seaming curl portion of the lid body or in the seaming flange portion of the container body, when the seaming roll advances upon seaming, the lid body or the container body is liable to be subjected to abnormal deformation due to the insufficient strength thereof in the vicinity of the notched portion. According to the lid body of the present invention, however, the short and small seaming portion is partially formed at a side of the notched portion thereby to make the length of the seaming curl portion short, and hence, by causing the seaming roll to advance from the short and small curl portion side toward the notched portion formed in the seaming curl portion, or from the short and small curl portion side toward a location which overlaps with the notched portion formed in the seaming flange portion, the seaming load can be reduced, thus making it possible to prevent the abnormal deformation of the lid body or the container body in the vicinity of the notched portion.

In particular, in cases where the lid body has a polygonal shape with its corners being each rounded and the notched portion is formed in the vicinity of a corner portion, the corner portions are subjected to drawing work at the time of seaming, and so become high in the seaming load. As a result, when the notched portion is in the vicinity of a corner portion, abnormal deformation will be liable to occur in the vicinity of the notched portion. For that reason, by forming a region including that corner portion into the short and small curl portion, it is possible to prevent the abnormal deformation of the container body or the lid body.

(Effect of the Method of Seaming a Container of the Present Invention)

In cases where the notched portion is formed in the seaming curl portion of the lid body or in the seaming flange portion of the container body, when the seaming roll advances upon seaming, the lid body or the container body is liable to be subjected to abnormal deformation due to the insufficient strength thereof in the vicinity of the notched portion. According to the present invention, however, the short and small seaming portion is partially formed at a side of the notched portion thereby to make the length of the seaming curl portion short, and hence, by causing the seaming roll to advance from the short and small curl portion side toward the notched portion, the seaming load can be reduced, so that it is possible to prevent the abnormal deformation of the lid body or the container body in the vicinity of the notched portion, thus making it possible to achieve the container of an accurate shape including the notch portion.

In particular, in cases where the container is a rectangular-shaped container in which its corners are each rounded and the notched portion is formed in the vicinity of a corner portion, the corner portions are subjected to drawing work at the time of seaming, and hence, a seaming load is high at the corner portions, as a result of which when the notched portion is in the vicinity of a corner portion, abnormal deformation will be liable to occur in the vicinity of the notched portion. For that reason, by forming a region including that corner portion into the short and small curl portion, it is possible to prevent the abnormal deformation of the container body or the lid body.

BRIEF DESCRIPTION OF THE DRAWINGS

FIG. 1 shows a container according to a first embodiment of the present invention, wherein (A) in this figure is a schematic perspective view; (B) in this figure is a schematic perspective view seen from a bottom surface side; and (C) in this figure is an exploded perspective view of a state before seaming with a bottom lid removed.

DETAILED DESCRIPTION OF THE INVENTION

In the following, the present invention will be described based on embodiments thereof as illustrated.

First Embodiment

Figure 1:
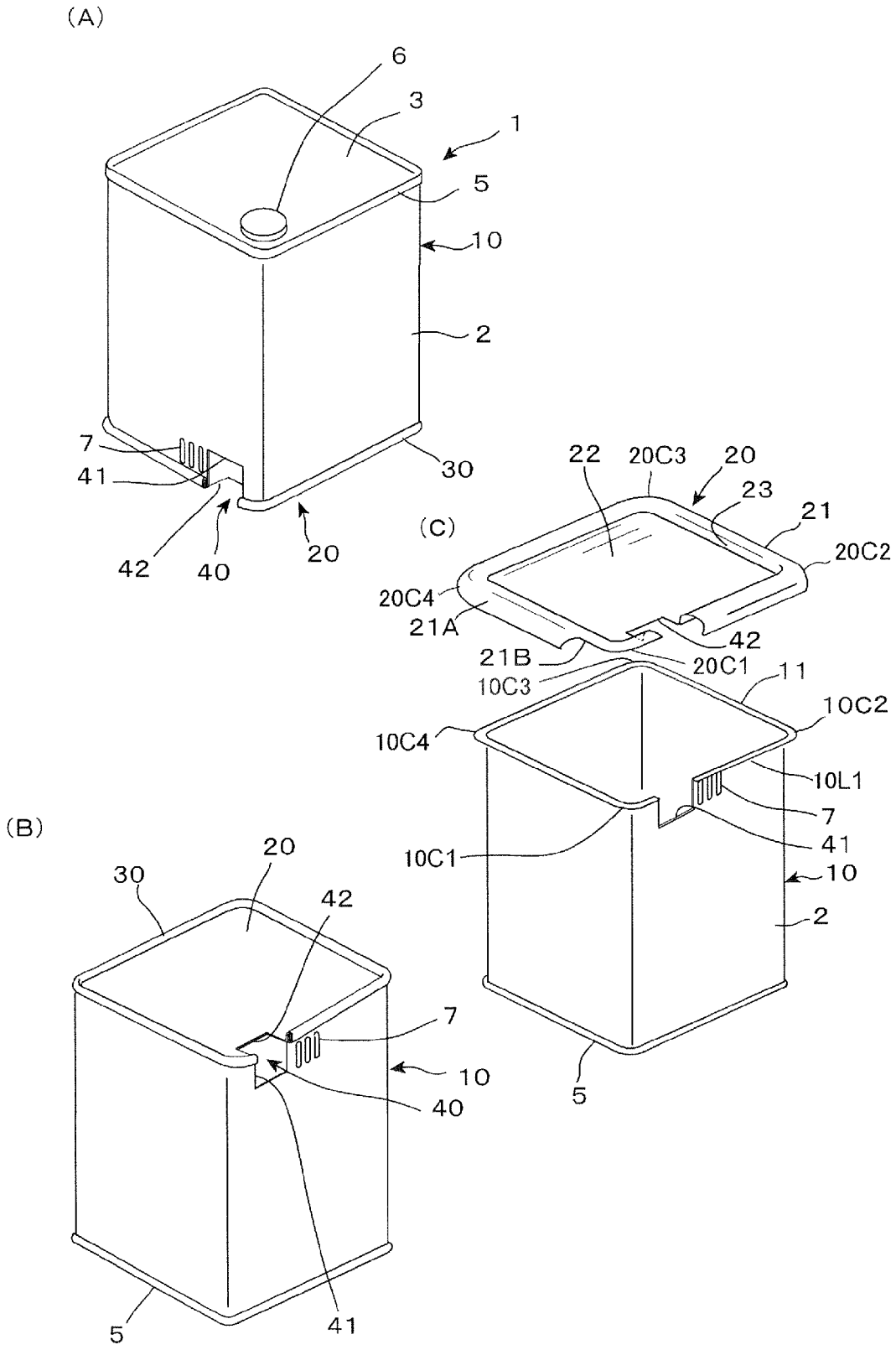
[FIG. 1]

FIG. 1 shows a container according to an embodiment of the present invention.

This container 1 is a polygonal can made of metal, and a top lid 3 and a bottom lid 20 are joined to an upper (top) and a lower (bottom) open end of a quadrangular cylinder-shaped body portion 2, respectively, by means of double seaming. A cap 6 to close an outlet port is mounted on the top lid 3 for free attachment and detachment. Both of the top lid 3 and the bottom lid 20 have seam portions 5, respectively, but in this embodiment, it is assumed that a container body 10 is composed of the body portion 2 and the top lid 3, wherein the present invention is applied to a seam portion 30 between the bottom lid 20, which is provided with a notch, and the body portion 2.

That is, it is constructed such that a seaming flange portion 11 formed at an open end portion of the body portion 2 at its bottom side, which constitutes the container body 10, and a seaming curl portion 21 formed on a periphery of the bottom lid 20 are seamed to be joined to each other. A notched portion is provided in at least one of the seaming curl portion 21 and the seaming flange portion 11, and in this example, notched portions 41, 42 are provided in both of them, respectively, and a partial opening portion 40 is formed of these notched portions 41, 42 in a corner portion of each of the bottom lid 20 and the body portion 2, so that it is constructed to make the inside and the outside of the container in communication with each other through the partial opening portion 40. This partial opening portion 40 may be separately closed by an unillustrated transparent plate or the like in a hermetical manner.

Although the above-mentioned container is formed of a metal material of a thin thickness, it is preferable to use a metal material which is covered with resin, in consideration of corrosion resistance, etc. For example, a galvanized steel plate such as TFS, etc., an aluminum alloy plate, a painted or film laminated tin plate, and so on are mentioned. It is preferable to carry out covering of a metal material with resin before molding of the container, but the covering may be carried out after molding of the container. As materials of the container 1, at least the bottom lid 20 and the top cover 3 may be formed of a material including a metal material, and for the body portion 2, other materials may be used, according to the circumstances.

The body portion 2 of the container body 10 has a corner-rounded (i.e., corners being rounded) quadrangular cylindrical shape, wherein its four side surfaces are flat surfaces and four corner portions 10C1, 10C2, 10C3, 10C4 have arc shapes. Then, the seaming flange portion 11 protrudes by a predetermined width along the rectilinear side portions and the arc-shaped corner portions in such a manner as to surround the open end of the body portion 2.

In addition, a notched portion 41 is formed in one rectilinear region 10L1 between the corner portions 10C1 and 10C2. This notched portion 41 is of a rectangular shape, as illustrated, but may be of another shape such as an arc shape, a V shape, a U shape, a trapezoidal shape, etc. The notched portion 41 extends by a predetermined length from the seaming flange portion 11 to a side surface portion of the body portion 2, and is located in the vicinity of the one corner portion 10C1. This vicinity of the corner portion 10C1 is a position apart by about the circumferential or peripheral length of the corner portion 10C1 from a position adjacent to the corner portion 10C1, but the distance for which the seaming load has an influence is affected by the shape and dimensions of the container body, the thickness of the metal material, etc., and so it is not necessarily limited to such a vicinity.

In addition, a plurality of ribs 7 for improving surface rigidity are formed on a side surface of the body portion 2 in a region adjacent to a side of the notched portion 41 opposite to the corner portion Cl. These ribs 7 extend in a direction crossing at a right angle with respect to the seaming flange portion 11.

On the other hand, the bottom lid 20 is composed of a panel portion 22 of a corner-rounded quadrangular shape which conforms to the shape of the open end of the body portion 2, and the seaming curl portion 21 which protrudes in such a manner as to surround the periphery of the panel portion 22. The seaming curl portion 21 protrudes by a predetermined length along the four sides portions of the panel portion 22 which extend in a rectilinear manner, and along the four arc-shaped corner portions 20C1, 20C2, 20C3 and 20C4 (refer to (A) in FIG. 3). The seaming curl portion 21 has a shape which curves in a semicircle cross-sectional shape through a chuck wall portion 23 rising from the periphery of the panel portion 22, and the length of the protrusion or overhang is longer than the overhang length of the seaming flange portion 11. Then, a notched portion 42, corresponding to the notched portion 41 of the seaming flange portion 11, is formed in one rectilinear region 20L1 between the corner portions 20C1, 20C2 of the seaming curl portion 21, in the vicinity of the one corner portion 20C1. This notched portion 42, too, is of a rectangular shape, as illustrated, but may be of another shape such as an arc shape, a V shape, a U shape, a trapezoidal shape, etc. The notched portion 42 extends a predetermined length from an outer end of the seaming curl portion 21 to the panel portion 22.

This notched portion 42 also has the same width as that of the notched portion 41 of the seaming flange portion 11, and extends from the outer end of the seaming curl portion 21 to the interior of the panel portion 22, so that both of the respective notched portions 41, 42 are put together to form the L-shaped partial opening portion 40.

The seaming curl portion 21 is formed with a short and small curl portion 21B, in which the width of protrusion or overhang of the seaming curl portion 21 is partially short, in a region where the notched portion is arranged, i.e., in a region including the corner portion 20C1 which becomes one of the opposite sides of the notched portion 42.

The seam portion 30 is such a construction that double seaming is carried out in a long and large curl portion 21A other than the short and small curl portion 21B, and has a shape which includes a long semicircular shape corresponding to the double seaming, and which has a length of about a quarter round arc in the short and small curl portion 21B.

The short and small curl portion 21B includes the arc-shaped corner portion 20C1, and extends a predetermined length to a rectilinear region 20L4 which is a region between the corner portion 20C1 and a corner portion opposing the notched portion 42 with respect to the corner portion 20C1. This length of the short and small curl portion 21B is preferable to be about the circumferential or peripheral length of the corner portion 20C1.

In addition, with respect to the rectilinear region 20L1, too, which is a region between corner portions at the side of the notched portion 42, it extends a predetermined length from the corner portion 20C1 toward the rectilinear region 20L1, i.e., up to the notched portion 42 in the illustrated example.

Figure 4:
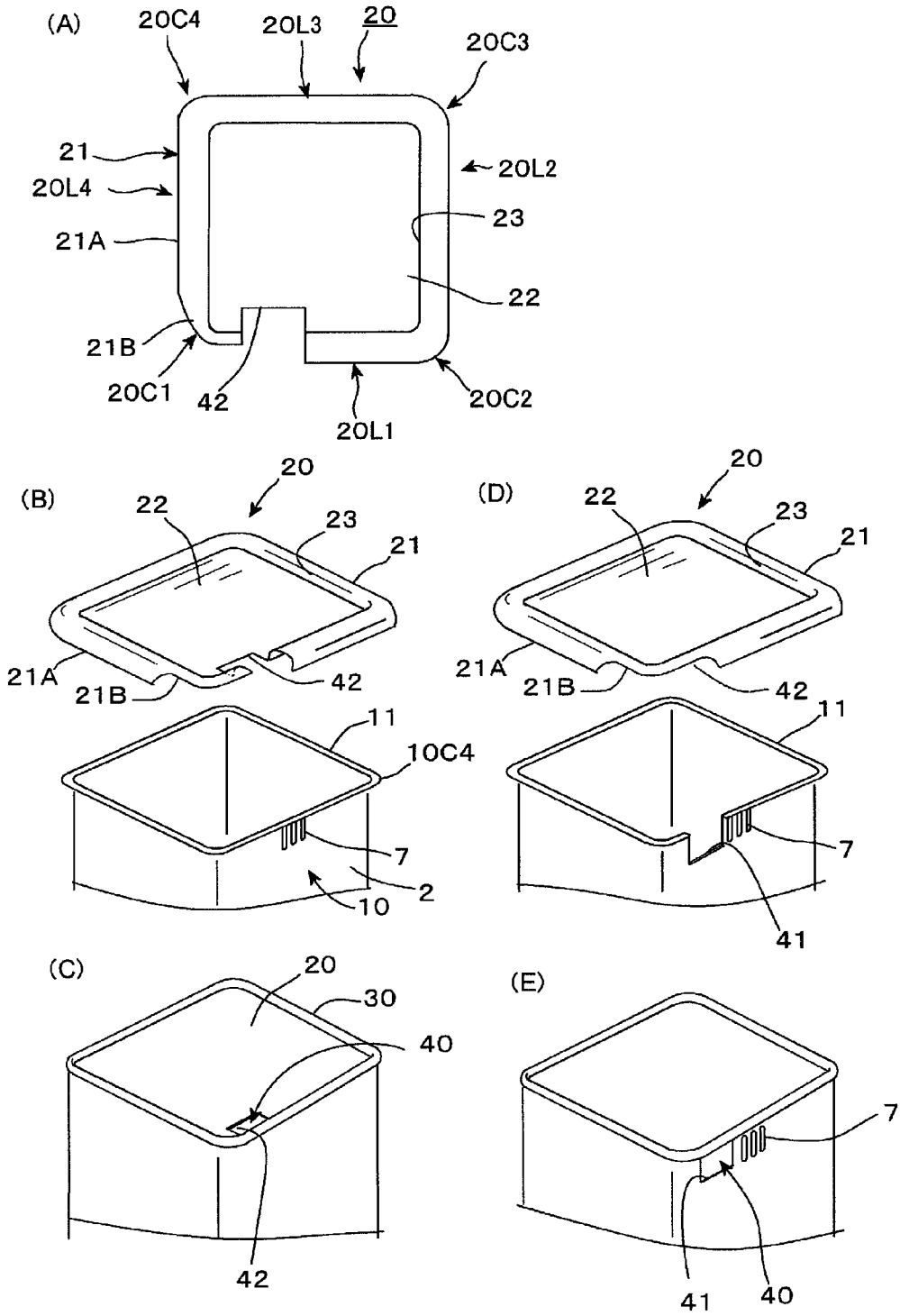
[FIG. 4] (A) in FIG. 4 is a view showing another example of a shape of a short and small curl portion of a seaming curl portion; and (B) through (E) are views showing other structural examples of a notched portion, respectively.
Figure 5:
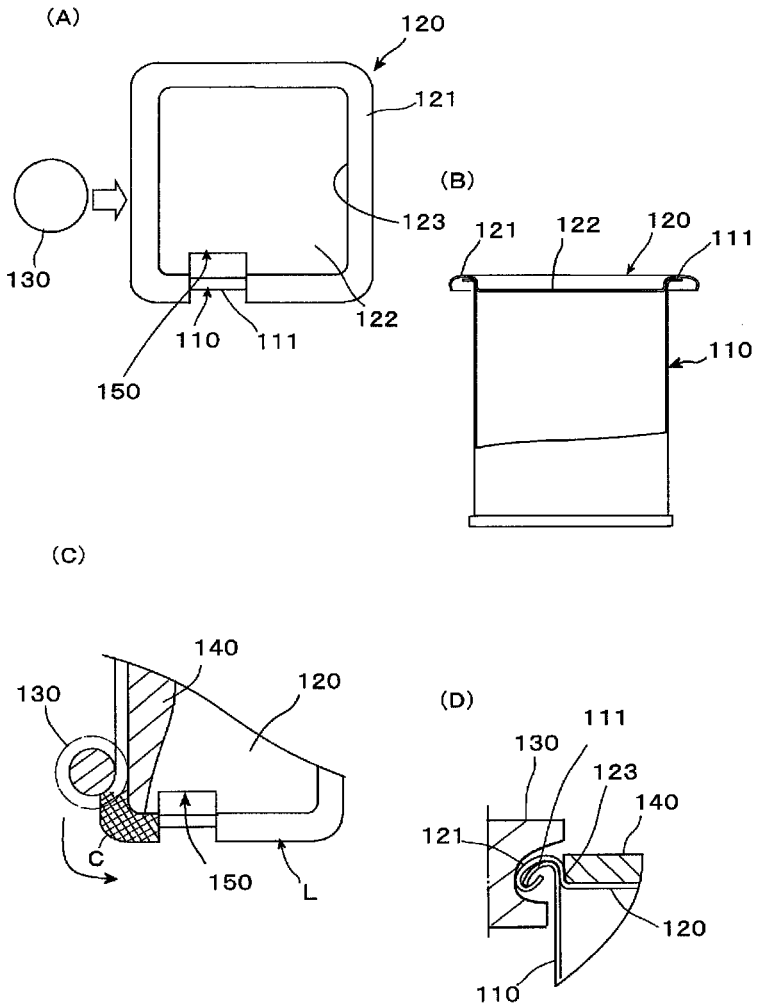
[FIG. 5] (A) through (D) in FIG. 5 are explanatory views of a conventional method of seaming a container.

Here, note that the short and small curl portion 21 B may be of a shape which becomes shorter in a gradual manner, as shown in (A) in FIG. 4.

Figure 2:
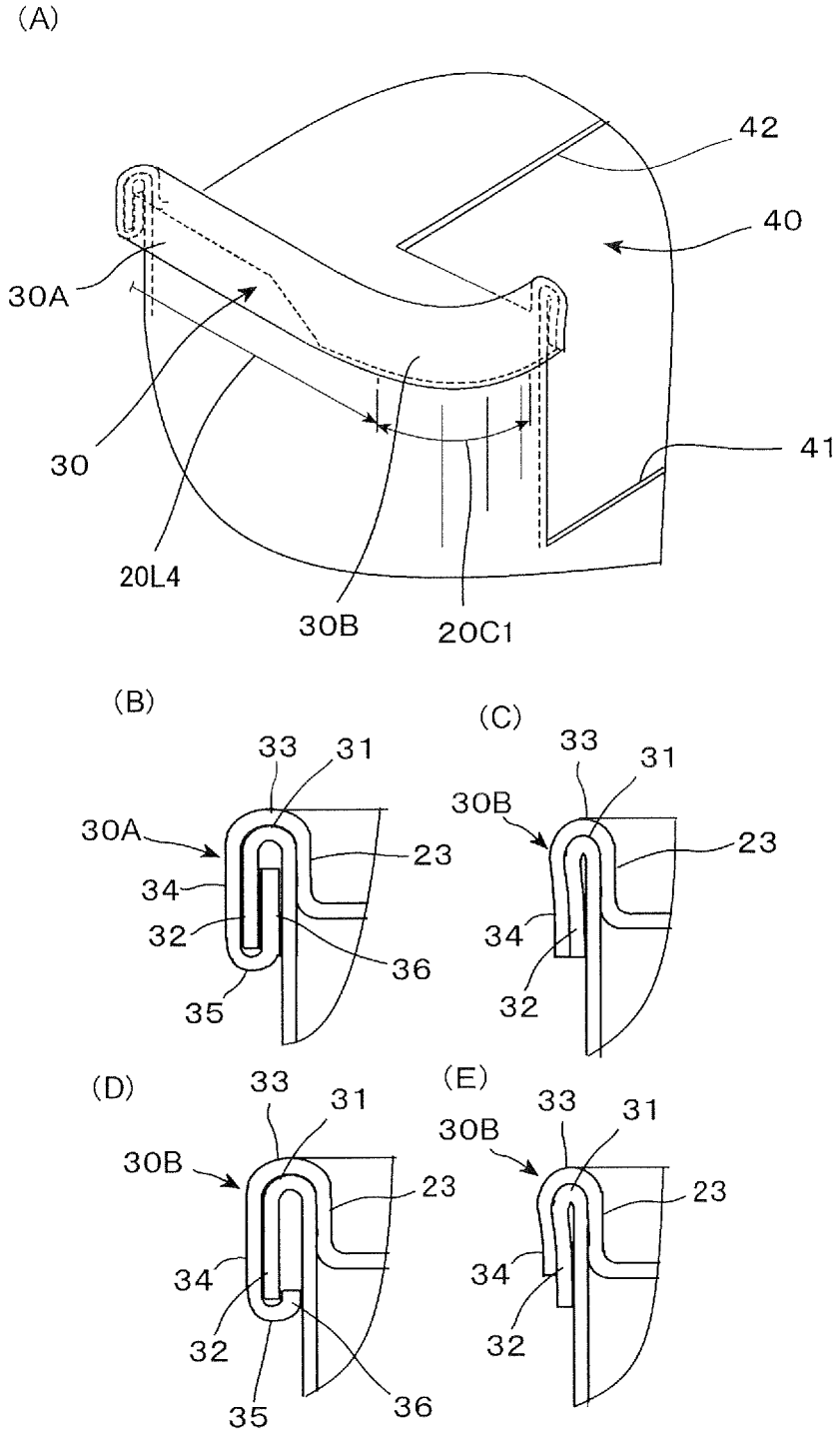
[FIG. 2] (A) in FIG. 2 is a partially enlarged perspective view of the vicinity of a corner portion in a seaming portion of the container of FIG. 1; (B) is a cross sectional view of a double seamed portion; (C) is a cross sectional view of a short and small seam portion; and (D) and (E) are cross sectional views of short and small seam portions, respectively, in which the lengths of the short and small curl portions are different from each other.

Basically, the seam portion 30 is composed of a double seam portion 30A in the long and large curl portion 21A, and a short and small seam portion 30B in the short and small curl portion 21B, as shown in (A) in FIG. 2. As shown in (B) in FIG. 2, the double seam portion 30A is constructed to be provided with a body hook radius 31, a body hook 32 which is turned back into a cylindrical shape by means of the body hook radius 31, a seaming panel 33 which covers the body hook radius 31, a seaming wall 34 which covers an outer periphery of the body hook, and a cover hook 36 which is sandwiched between the body hook 32 and an outer periphery of the container body portion 2 through the cover hook radius 35 covering a tip of the body hook 32. The body hook radius 31 and the body hook 32 are those portions in which the seaming flange portion 11 has been subjected to plastic deformation, and the seaming panel 33, the seaming wall 34, the cover hook radius 35 and the cover hook 36 are those portions in which the long and large curl portion 21A of the seaming curl portion 21 has been subjected to plastic deformation.

On the other hand, in the short and small seam portion 30B, a short seaming structure is formed only for the length of the cover hook 36 of the above-mentioned double seam portion 30A, for example, as shown in (C) in FIG. 2. That is, the structure is provided with the body hook 32 which is formed by being turned back into a cylindrical shape by means of the body hook radius 31, and the seaming wall 34 which is turned back through the seaming panel 33 at the tip of the chuck wall portion, to cover the outer periphery of the body hook 32. Seam thickness in the short and small curl portion 21B is thinner, by the absence of the cover hook 36, than that in the portion of the double seam portion 30A in the rectilinear region, and seam thickness in a corner portion region becomes equal to or thinner than the thickness of the double seam portion 30A.

The structure of the short and small seam portion may be as follows. The short and small seam portion may have such a length that the cover hook 36 is partially formed by the length of the short and small curl portion, for example, as shown in (D) in FIG. 2, or the length of the seaming wall 34 may be shorter than the length of the body hook 32, as shown in (E) in FIG. 2.

Here, note that the seaming flange portion 11 is difficult to be changed to a large extent due to the restriction of trimming tools, but may also be made shorter, as necessary, according to an amount of reduction of the short and small curl portion 21B.

Next, reference will be made to a seaming method of the above-mentioned container.

Figure 3:
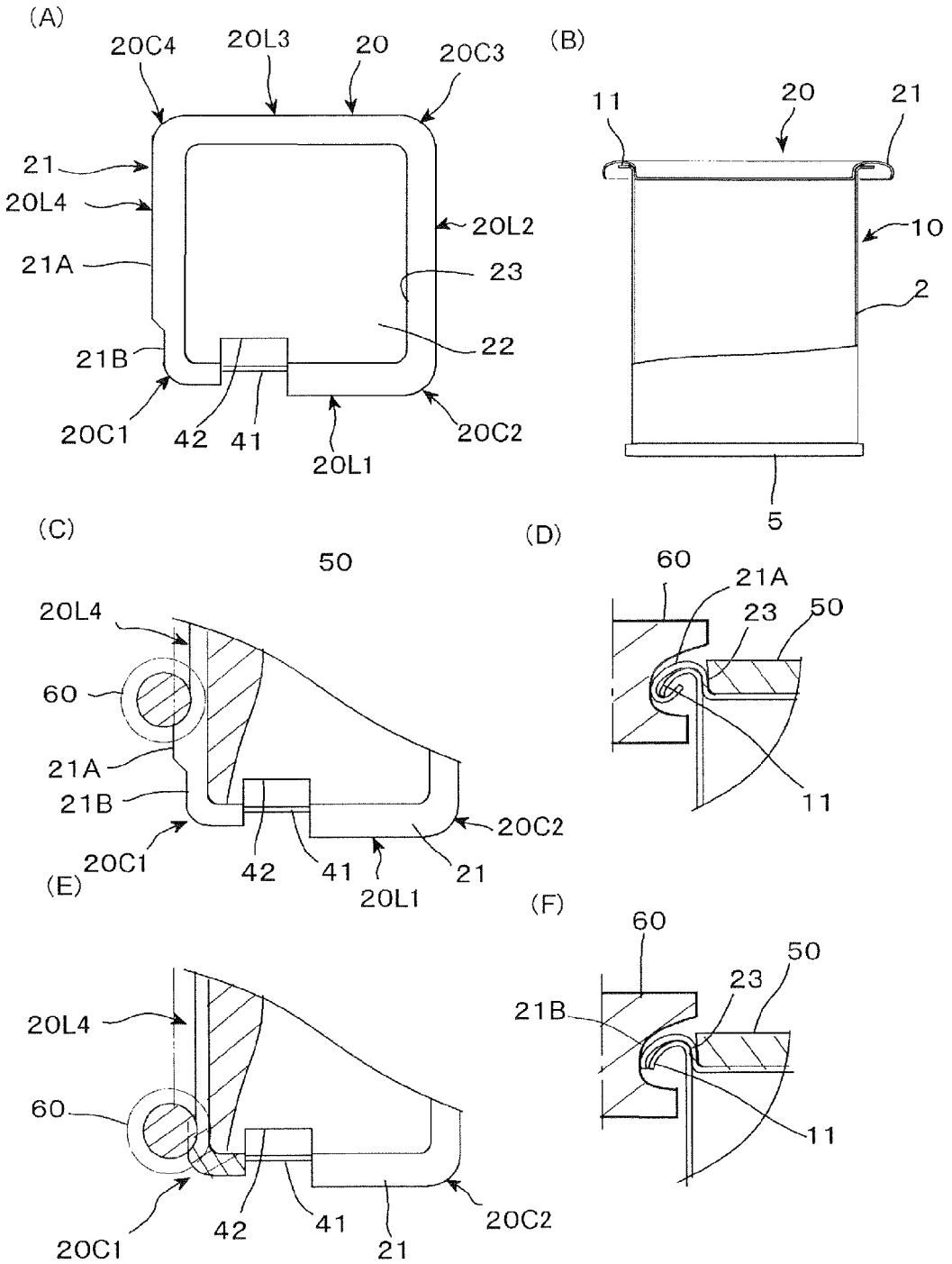
[FIG. 3] (A) through (D) in FIG. 3 are an explanatory views showing a seaming process in a method of seaming a container according to the present invention.

As shown in FIG. 3, the seaming curl portion 21 of the bottom lid 20, which is a lid body, is put or overlapped on the seaming flange portion 11 at the open end portion of the container body 10 (refer to (A) and (B) in FIG. 3).

Then, by applying a chuck 50 to an inner periphery of the chuck wall portion 23, the seaming curl portion 21 and the seaming flange portion 11 thus overlapped with each other are pushed toward the chuck 50 by means of a seaming roll 60, so that they are caused to move in a circumferential direction, while being compressing between the chuck 50 and the seaming roll 60, thereby forming a double seam or a short and small seam. The seaming is carried out several times in a stepwise manner, though not illustrated in particular. At that time, it is preferable to carry out the seaming two times, as in the case of well-known double seaming.

In this embodiment, the corner portion 20C1 is formed with the short and small curl portion 21B in which the overhang width of the seaming curl portion 21 is shorter than the overhang width of each location (in this embodiment, 20C2, 20L2, 20C3, 20L3, 20C4) in which ordinary double seaming is carried out, and seaming is carried out toward the corner portion 20C1 from the rectilinear region 20L4 between the corner portion 20C1 and a corner portion opposing the notched portion 42 with respect to the corner portion 20C1 (refer to (C) through (F) in FIG. 3).

At the time of seaming this corner portion 20C1, the seaming curl portion 21 and the seaming flange portion 11 are subjected to drawing work, so the seaming load becomes high in these portions. As a result, when the notched portions 41, 42 are formed at locations adjacent to the corner portion 20C1 or at locations separated therefrom by about the peripheral or circumferential length of the corner portion 20C1, abnormal deformation will be liable to occur in the vicinity of the notched portions 41, 42 of the container body 10 and the bottom lid 20. According to the present invention, by forming the seaming curl portion 21 in a region including this corner portion 20C1 into the short and small curl portion 21B, it is possible to reduce the seaming load, thus making it possible to prevent the abnormal deformation of the container body portion 2 or the bottom lid 20.

Here, note that in the above-mentioned embodiment, an example has been showed in which the notched portions 41, 42 are formed in both the body portion 2 of the container body 10 and the bottom lid 20, respectively, but the present invention can also be applied to a case where the notched portion 42 is formed only in the bottom lid 20, as shown in (B) and (C) in FIG. 4, and the present invention can also be applied to an example in which the notched portion 41 is formed only in the body portion 2, as shown in (D) and (E) in FIG. 4.

In cases where the notched portion 41 is formed only in the seaming flange portion 11 of the body portion 2 of the container body 10, the short and small curl portion 21B formed in the seaming curl portion 21 of the bottom lid 20 will be formed at least at one side of circumferentially opposite sides of a region where the notched portion 41 is formed, i.e., a location which overlaps with the notched portion 41.

In addition, although in the above-mentioned embodiment, the container having a quadrangular cylindrical shape has been explained, it is not limited to the quadrangular cylindrical shape, and the present invention can be applied to a polygonal shape such as a triangle, a pentagon, or a polygon having more than five angles or sides. In addition, the region between the corner portions does not need to be rectilinear, but may be arc-shaped with its radius of curvature being larger than those of the corner portions. Moreover, the invention can be applied not only to quadrangular containers but also to containers with their body portions being oval in cross section, and can also be applied to containers of circular cross section.

In other words, the length of the seaming curl portion is made short by partially forming the short and small curl portion at a side of the notched portion at which the seaming roll is caused to enter, and the seaming roll is caused to enter or advance toward the notched portion from the short and small curl portion side, so that the seaming load can be decreased, thereby preventing the abnormal deformation of the lid body or the container body in the vicinity their notched portions.

In addition, although in the above-mentioned embodiment, a three-piece structural example has been shown in which a body portion, a top lid and a bottom lid are formed separately from one another, a two-piece structure may, of course, also be available in which the body portion and the top lid are formed into an integral structure.

The present invention can also be applied to cases or the like of various kinds of devices, etc., and can be widely applied to seamed containers each having a notched portion in a body portion or a lid body.

EXPLANATION OF REFERENCE NUMERALS AND CHARACTERS

1 container,
2 body portion,
3 top lid,
5 seam portion,
6 cap,
7 ribs
10 container body
10C1, 10C2, 10C3, 10C4 corner portions
10L1 rectilinear region
11 seaming flange portion

20 bottom lid (lid body)
20C1, 20C2, 20C3, 20C4 corner portions
20L1, 20L2, 20L3, 20L4 rectilinear regions
21 seaming curl portion
21A long and large curl portion
21B short and small curl portion
22 panel portion
23 chuck wall portion
30 seam portion
30A double seam portion
30B short and small seam portion
31 body hook radius,
32 body hook,
33 seaming panel,
34 seaming wall,
35 cover hook radius
36 cover hook
40 partial opening portion
41, 42 notched portions
50 chuck
60 seaming roll

The invention claimed is:

1. A container comprising a seaming flange portion at an open end portion of a container body, and a seaming curl portion on a periphery of a lid body wherein said seaming flange portion and said seaming curl portion are joined together, with said container having a notched portion in at least one of said seaming curl portion and said seaming flange portion, wherein in at least one of circumferentially adjacent sides of said notched portion, said seaming curl portion has a short and small curl portion having a width of protrusion of said seaming curl portion, and in said seaming curl portion other than said short and small curl portion there is a long and large curl portion having a width of protrusion of said seaming curl portion, wherein the width of protrusion of said short and small curl portion is less than the width of protrusion of said long and large curl portion.

2. The container as set forth in claim 1, wherein said container body and said lid body are each of a polygonal shape with rounded corner portions, said notched portion is in a region between said corner portions, and said short and small curl portion of said seaming curl portion is in a region including a corner portion in the vicinity of said notched portion.

3. A container comprising a seaming curl portion on a periphery of a lid body and a seaming flange portion at an open end of a container body, wherein said seaming curl portion and said seaming flange portion are joined together, wherein said seaming curl portion has a short and small curl portion having a length of protrusion of said seaming curl portion, and wherein a notched portion is in said seaming curl portion, and said short and small curl portion is in at least one of circumferentially adjacent sides of said notched portion, wherein said seaming curl portion other than said short and small curl portion there is a long and large curl portion having a length of protrusion of said seaming curl portion, wherein the length of protrusion of said short and small curl portion is shorter than the length of protrusion of said long and large curl portion.

4. The container as set forth in claim 3, wherein said lid body has a polygonal shape with rounded corner portions, the notched portion is in a region between adjacent corner portions and in the vicinity of one of the corner portions, and the short and small curl portion of said seaming curl portion is in a corner portion in the vicinity of the notched portion.

5. A method of seaming a container in which a seaming curl portion on a periphery of a lid body is overlapped on a seaming flange portion at an open end of a container body, and said seaming curl portion and said seaming flange portion thus overlapped are joined together by a seaming roll which moves in a circumferential direction with respect to said seaming curl portion, said method comprising:

forming a notched portion in advance in at least one of said seaming flange portion and said seaming curl portion;

forming a short and small curl portion in advance in said seaming curl portion having a length of protrusion of said seaming curl portion in at least one of circumferentially adjacent sides of said notched portion, wherein said seaming curl portion other than said short and small curl portion there is a long and large curl portion having a length of protrusion of said seaming curl portion, wherein the length of protrusion of said short and small curl portion is shorter than the length of protrusion of said long and large curl portion; and seaming said seaming curl portion and said seaming flange portion by moving said seaming roll from a side of said short and small curl portion toward said notched portion at the time of seaming.

6. The method of seaming a container as set forth in claim 5, wherein said container body and said lid body each have a polygonal shape with rounded corner portions, said notched portion is formed in a region between said corner portions, and said short and small curl portion of said seaming curl portion is formed in a region including a corner portion in the vicinity of said notched portion.

* * * * *